US010078342B2

(12) United States Patent
Kossel

(10) Patent No.: US 10,078,342 B2
(45) Date of Patent: Sep. 18, 2018

(54) LOW DROPOUT VOLTAGE REGULATOR WITH VARIABLE LOAD COMPENSATION

(71) Applicant: International Business Machines Corporation, Armonk, NY (US)

(72) Inventor: Marcel A. Kossel, Reichenburg (CH)

(73) Assignee: International Business Machines Corporation, Armonk, NY (US)

( * ) Notice: Subject to any disclaimer, the term of this patent is extended or adjusted under 35 U.S.C. 154(b) by 4 days.

(21) Appl. No.: 15/192,478

(22) Filed: Jun. 24, 2016

(65) Prior Publication Data

US 2017/0371365 A1 Dec. 28, 2017

(51) Int. Cl.

| | |
|---|---|
| ***G05F 1/575*** | (2006.01) |
| *G05F 3/26* | (2006.01) |
| *G05F 1/46* | (2006.01) |
| *G05F 1/563* | (2006.01) |
| *G05F 1/565* | (2006.01) |

(52) U.S. Cl.

CPC ..... *G05F 1/575* (2013.01); *G05F 1/46* (2013.01); *G05F 1/461* (2013.01); *G05F 1/462* (2013.01); *G05F 1/563* (2013.01); *G05F 1/565* (2013.01); *G05F 3/26* (2013.01)

(58) Field of Classification Search

CPC . G05F 1/46; G05F 1/461; G05F 1/462; G05F 1/563; G05F 1/565; G05F 1/575; G05F 3/26

See application file for complete search history.

(56) References Cited

U.S. PATENT DOCUMENTS

| | | | | |
|---|---|---|---|---|
| 6,300,749 | B1 * | 10/2001 | Castelli | G05F 1/575 323/273 |
| 7,612,548 | B2 * | 11/2009 | Jian | G05F 1/575 323/280 |
| 7,755,338 | B2 | 7/2010 | Taha et al. | |
| 7,956,589 | B1 | 6/2011 | Fan | |
| 8,188,719 | B2 | 5/2012 | Sudou | |
| 8,193,794 | B2 | 6/2012 | Peng et al. | |

(Continued)

OTHER PUBLICATIONS

Leung et al., "A CMOS Low-Dropout Regulator With a Momentarily Current-Boosting Voltage Buffer", IEEE Transactions on Circuits and Systems, Regular Papers, vol. 57, Issue: 9, Sep. 2010, Abstract only.

*Primary Examiner* — Fred E Finch, III
*Assistant Examiner* — Rafael O. De León Domenech
(74) *Attorney, Agent, or Firm* — Scully, Scott, Murphy & Presser, P.C.; Daniel Morris, Esq.

(57) ABSTRACT

A voltage regulator comprising an error amplifier, a pass transistor and a buffer circuit arranged between the error amplifier and the pass transistor. The buffer circuit comprises a load detector configured to detect a load current of the regulator by monitoring an output signal of the error amplifier. The buffer circuit further comprises a load compensator configured to receive a load signal from the load detector. The load signal indicates the load of the regulator. The load compensator is further configured to change its output impedance based on the load signal such that variations of the load of the voltage regulator are compensated. There is additionally provided a corresponding system, a corresponding method and a corresponding design structure.

14 Claims, 6 Drawing Sheets

400

(56) References Cited

U.S. PATENT DOCUMENTS

| | | | | |
|---|---|---|---|---|
| 2010/0052635 | A1* | 3/2010 | Wang | G05F 1/575 323/280 |
| 2011/0068758 | A1* | 3/2011 | Chiu | G05F 1/575 323/280 |
| 2012/0038332 | A1* | 2/2012 | Lin | G05F 1/575 323/277 |
| 2013/0285631 | A1* | 10/2013 | Bisson | G05F 1/575 323/280 |
| 2013/0314061 | A1 | 11/2013 | Forghani-Zadeh et al. | |
| 2014/0082385 | A1* | 3/2014 | Reule | G06F 1/266 713/320 |
| 2014/0191739 | A1* | 7/2014 | Kim | G05F 1/56 323/280 |
| 2016/0173066 | A1* | 6/2016 | Yang | H03K 19/0013 327/109 |
| 2016/0349776 | A1* | 12/2016 | Conte | G05F 1/575 |

* cited by examiner

LOW DROPOUT VOLTAGE REGULATOR WITH VARIABLE LOAD COMPENSATION

BACKGROUND

The present disclosure relates to a voltage regulator, in particular to a low dropout voltage regulator.

The disclosure further relates to a corresponding system, a corresponding method and a corresponding design structure.

Voltage regulators are widely used in electronic circuits to supply the various components with the desired voltage level. Low dropout (LDO) voltage regulators are linear voltage regulators that are powered with a supply voltage that is close to the desired output voltage.

The stability of the LDO regulators is important for reliable device operation and is in particular challenging if the load of the LDO regulator comprises large changes and load steps.

Double data rate (DDR) memory links use burst-mode signaling, which means that data is transmitted in bursts of several bytes and in between these transmission bursts the transmitter is either in termination mode for the reception of data from the DRAM or in idle mode, the latter providing a high impedance state. The LDO regulator of such memory links has therefore to cope with large load steps when the DDR transmitters switch between active mode, termination mode or idle state. Large load steps are challenging for the loop dynamics of the voltage regulation because they strongly affect the frequency compensation and stability of the regulator.

BRIEF SUMMARY

According to a first aspect, the present disclosure is directed to voltage regulator. The voltage regulator comprises an error amplifier, a pass transistor and a buffer circuit arranged between the error amplifier and the pass transistor. The buffer circuit comprises a load detector configured to detect a load current of the regulator by monitoring an output signal of the error amplifier. The buffer circuit further comprises a load compensator configured to receive a load signal from the load detector. The load signal indicates the load of the regulator. The load compensator is further configured to change its output impedance based on the load signal such that variations of the load of the voltage regulator are compensated.

According to another aspect, the disclosure is directed to a system comprising a voltage regulator according to the first aspect and a computerized device, in particular a DDR memory module.

According to another aspect, the disclosure includes an embodiment of a method for handling load changes of a voltage regulator according to the first aspect.

The method comprises a step of monitoring, by the load detector, an output signal of the error amplifier. The method comprises a further step of detecting, by the load detector, a load change of the voltage regulator. A further step comprises receiving, by the load compensator, a load signal from the load detector. The load signal indicates the load of the regulator. The method comprises a further step of changing the output impedance of the load compensator based on the received load signal. Thereby variations of the load of the voltage regulator are compensated.

According to yet another aspect, the disclosure includes an embodiment of a design structure tangibly embodied in a machine readable medium for designing, manufacturing, or testing an integrated circuit. The design structure comprises a voltage regulator according to the first aspect.

Devices and methods embodying the present invention will now be described, by way of non-limiting examples, and in reference to the accompanying drawings. Technical features depicted in the drawings are not necessarily to scale. Also some parts may be depicted as being not in contact to ease the understanding of the drawings, whereas they may very well be meant to be in contact, in operation.

DETAILED DESCRIPTION

Figure 1:
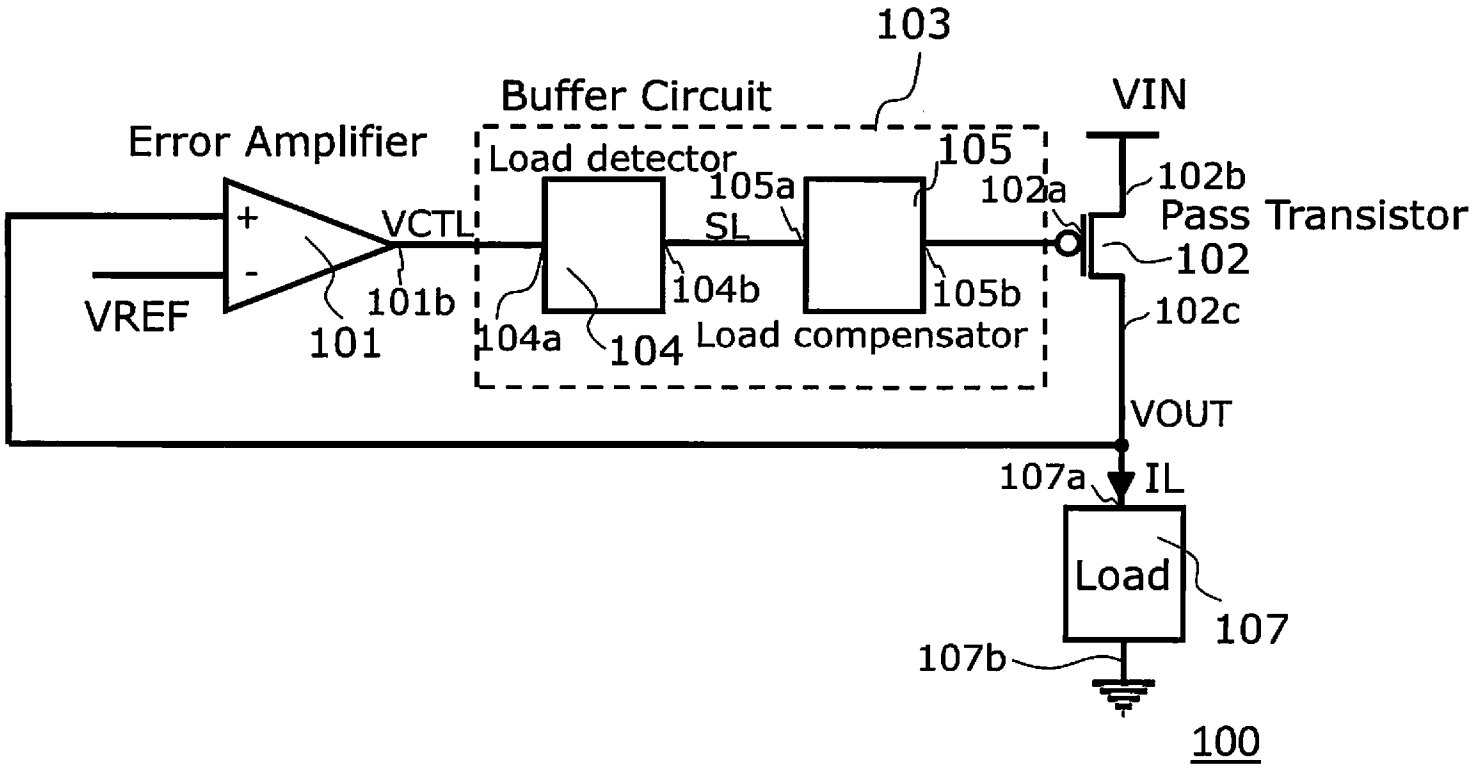
FIG. 1 shows a schematic diagram of an exemplary embodiment of a voltage regulator.

FIG. 1 shows a schematic block diagram of an exemplary embodiment of voltage regulator 100 according to the present disclosure.

The voltage regulator 100 is implemented as low dropout voltage regulator. It comprises an error amplifier 101, a pass transistor 102 and a buffer circuit 103. The buffer circuit 103 is arranged between the error amplifier 101 and the pass transistor 102. The buffer circuit 103 comprises a load detector 104 and a load compensator 105. An input 104*a* of the load detector 104 is coupled to an output 101*b* of the error amplifier 101. An output 104*b* of the load detector 104 is coupled to an input 105*a* of the load compensator 105. The pass transistor 102 may be in particular implemented as power Field Effect Transistor (FET). An output 105*b* of the load compensator 105 is coupled to the gate 102*a* of the pass transistor 102. The source 102*b* of the pass transistor 102 is coupled to an input supply voltage VIN. The drain 102*c* of the pass transistor 102 is coupled to a first terminal 107*a* of a load 107. A second terminal 107*b* of the load 107 is coupled to ground. According to embodiments the load 107 is implemented as DDR-transmitter.

The voltage regulator 100 is configured to regulate an output voltage VOUT at the drain of the pass transistor from the higher input voltage VIN. More particularly, the output voltage VOUT shall be regulated to be equal to a reference voltage VREF. According to embodiments of the present disclosure the reference voltage VREF is 0.7×VIN. The reference voltage VREF is fed to an inverting input of the error amplifier 101. The regulated output voltage VOUT is fed to a non-inverting input of the error amplifier 101. An output signal VCTL of the error amplifier 101 is fed to the input node 104*a* of the load detector 104.

The load detector 104 monitors the output voltage VCTL provided by the error amplifier 101 and provides a load signal SL to the load compensator 105. The load compensator 105 is configured to receive the load signal SL from the load detector 104. The load signal SL indicates the current load of the regulator 100. The load compensator 105 is further configured to change its output impedance based on the load signal SL such that variations of the load of the voltage regulator 100 are compensated so that the corresponding frequency pole remains substantially unchanged and the phase margin and frequency compensation become unaffected by load step changes.

The voltage regulator according to embodiments of the present disclosure solves the problem that load changes of the voltage regulator affect its stability. With the load detector 104 the load of the voltage regulator 100 can be detected and with the load compensator 105 the frequency compensation can be adjusted correspondingly so that the phase margin remains unchanged under different load conditions.

Figure 2:
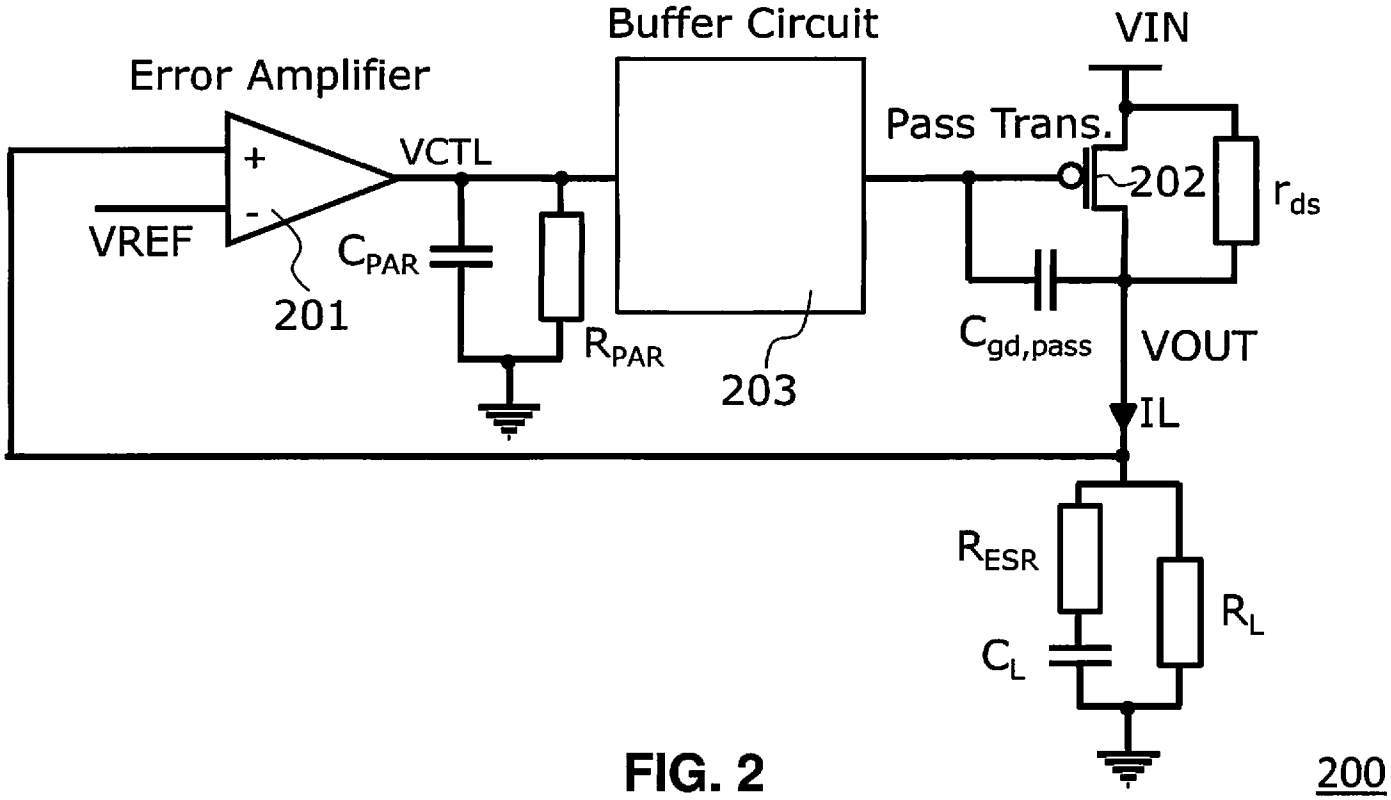
FIG. 2 shows a schematic block diagram of a low dropout voltage regulator illustrating in more detail the frequency behavior of the regulation loop.

FIG. 2 shows a schematic block diagram of a low dropout voltage regulator 200 according to an embodiment of the present disclosure illustrating in more detail the frequency behavior of the regulation loop.

The load of the voltage regulator 200 is represented by a parallel circuit comprising a first branch comprising in series a resistance $R_{ESR}$ representing an equivalent series resistance and a load capacitance $C_L$. A second branch comprises a load resistance $R_L$.

The regulation loop of the voltage regulator 200 comprises an error amplifier 201, a buffer circuit 203, a pass transistor 202 and a feedback path between the drain of the pass transistor 202 and a non-inverting input of the error amplifier 201. The error amplifier 201 generates as output signal a control signal VCTL by comparison between the reference voltage VREF and the output signal VOUT provided as feedback signal to the non-inverting input of the error amplifier 201.

The pass transistor 202 is assumed to have a drain-source resistance $r_{ds}$, a gate-drain capacitance $C_{gd,pass}$ and a transconductance $g_{m,pass}$. The error amplifier 201 is assumed to have a transconductance $g_{m,error}$. Furthermore, it is assumed that the error amplifier 201 has at its output a parasitic shunt resistance $R_{par}$ and a parasitic shunt capacitance $C_{par}$.

In the following the frequency behavior of the voltage regulator 200 with and without the buffer circuit 203 is illustrated.

A high regulation and power supply rejection ratio (PSR) may be achieved by increasing the loop gain via a large output resistance of the error amplifier 201. For a large load current IL of the voltage regulator 200 and low-dropout performance, the pass transistor 202 has preferably a large W/L ratio. If the load current IL is small, the associated large output impedance along with the load capacitance $C_L$ creates a low frequency pole. This decreases the overall phase margin. The drain impedance of the pass transistor 202 is inversely proportional to the load current IL. Accordingly the pole at the drain of the pass transistor 202 is dependent on the load condition.

According to embodiments the buffer circuit 203 is configured to sense the load condition of the voltage regulator 200 and to adjust the location of the pertinent pole such that it compensates for any possible pole displacements due to load variations.

Embodiments of the present disclosure provide a load-sensitive frequency compensation scheme via the buffer circuit 203 between the error amplifier 201 and the pass transistor 202. The buffer circuit 203 comprises circuitry that detects the load of the voltage regulator 200 and reacts correspondingly to maintain the stability of the voltage regulator 200.

Without the buffer circuit 203 the open loop transfer characteristic H of the voltage regulator 200 may be described by the following formula as disclosed by C. K. Chava and J. Silva-Martinez in "A frequency compensation scheme for LDO voltage regulators," IEEE Trans. Circuits Syst. I, Reg. Papers, vol. 51, no. 6, pp. 1041-1050, June 2004.

$$H(s) \cong \frac{A_0\left(1+\frac{s}{\omega_{ESR}}\right)}{\left(1+\frac{s}{\omega_{P1}}\right)\left(1+\frac{s}{\omega_{P2}}\right)},$$

where the open-loop gain $A_0$ is given by $$A_0 = g_{m,error} g_{m,pass} (r_{ds} \| R_L).$$

The zero and poles are located at the following frequencies:

$$\omega_{ESR} = \frac{1}{R_{ESR} C_L};$$

$$\omega_{P1} \approx \frac{1}{(r_{ds} \| R_L) C_L};$$

$$\omega_{P2} \approx \frac{1}{R_{par}(C_{par} + g_{m,pass}(r_{ds} \| R_L) C_{gd,pass})}.$$

As can be seen from these formulas, the worst case phase margin occurs at small load currents IL where the output impedance of the voltage regulator 200 is high and instability might occur if the zero is located at very high frequencies. On the other hand when the load currents IL are high and the output impedance becomes small, the closed-loop unity gain frequency increases and the high-frequency parasitic poles contribute in a stronger fashion to phase margin reductions.

According to embodiments of the present disclosure the higher frequency pole $\omega_{p2}$, which is dependent on changes of the output impedance $R_L$, is modified by the buffer circuit 203 in such a way that it creates a "compensated impedance $R_{par}$" at the output of the error amplifier that compensates for variations of $R_L$ so that the phase margin remains unchanged or substantially unchanged.

According to embodiments the buffer circuit 203 comprises a source follower buffer with shunt feedback as will be explained in more detail below.

Figure 3:
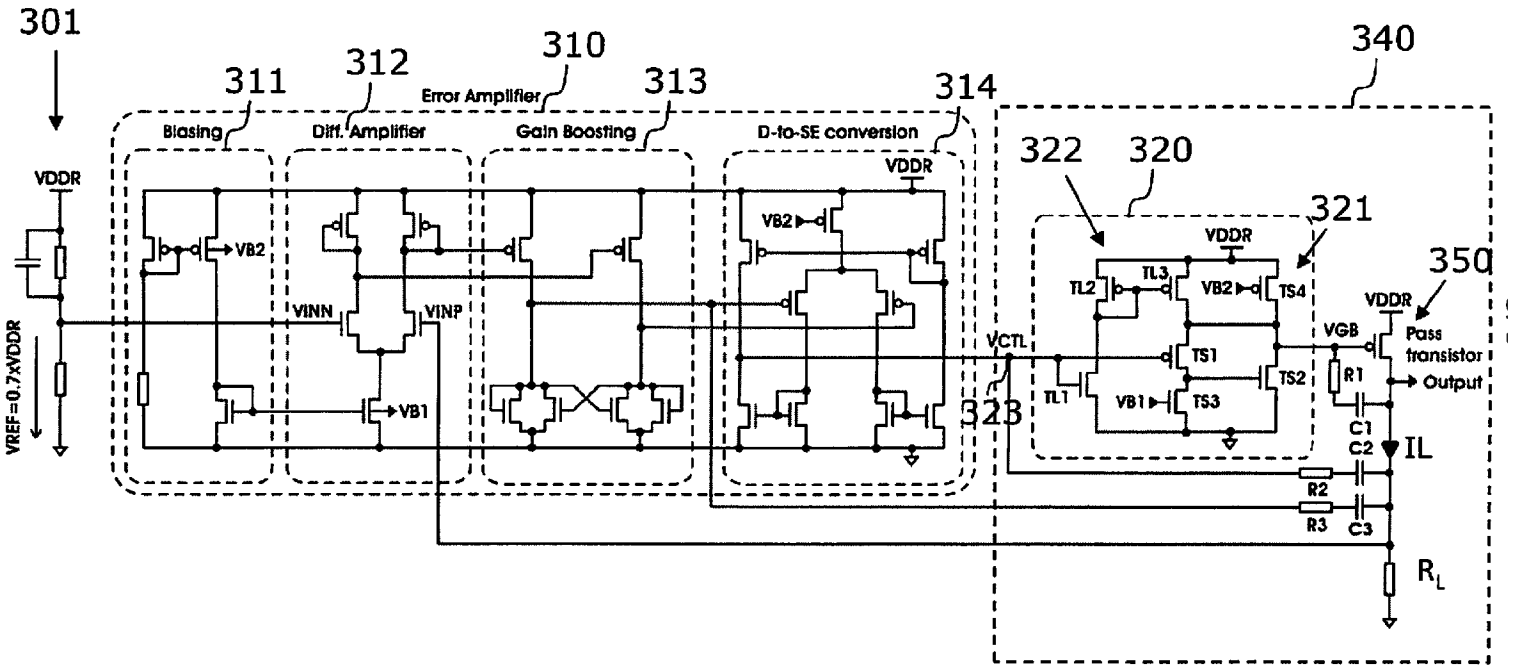
FIG. 3 shows a more detailed embodiment of a voltage regulator according to an embodiment of the present disclosure comprising a source follower buffer with shunt feedback.
Figure 4:
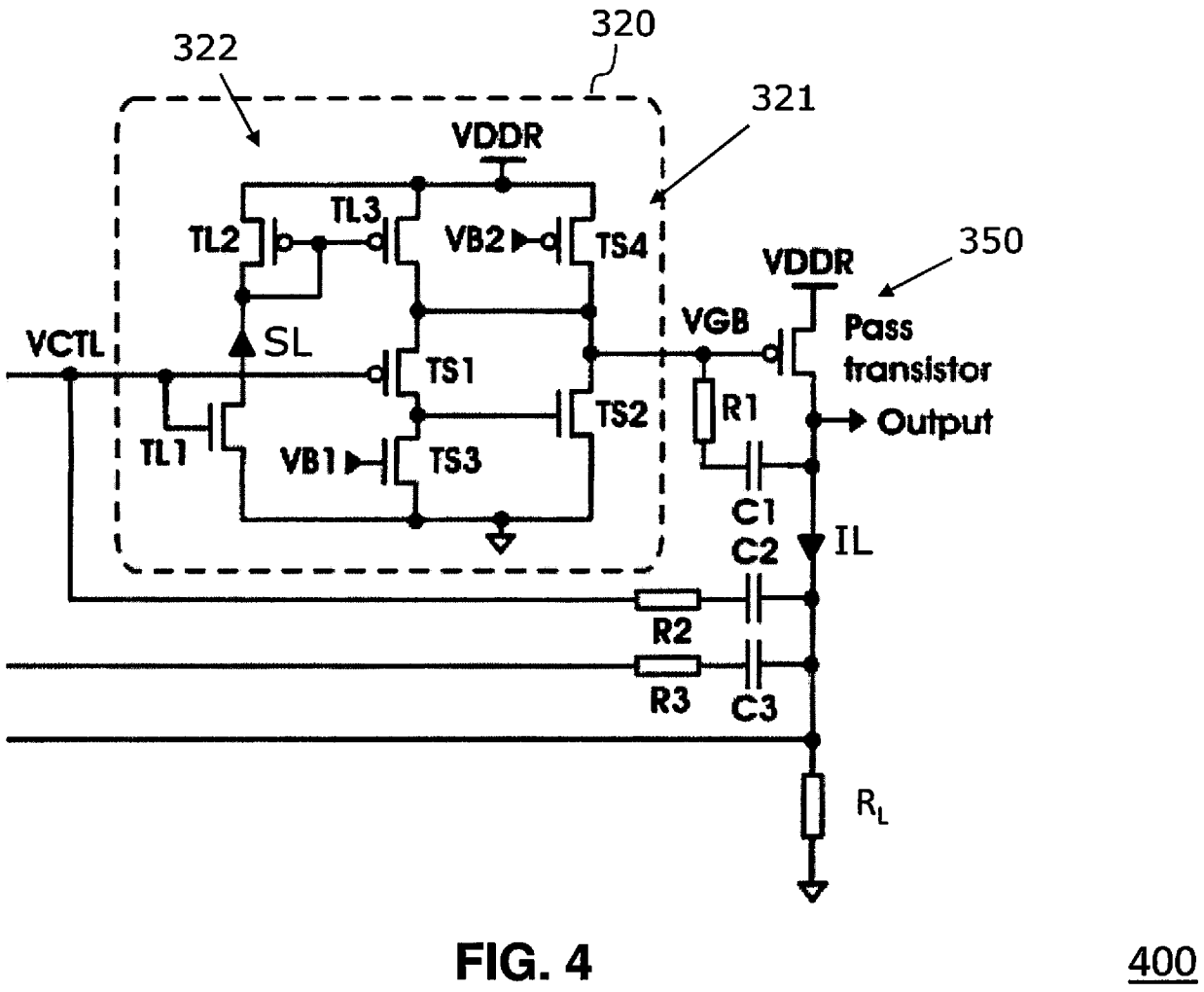
FIG. 4 shows an enlarged view of the source follower buffer with shunt feedback.

FIG. 3 shows as voltage regulator 300 a more detailed embodiment of the voltage regulator 100 of FIG. 1. FIG. 4 shows an enlarged view of a section 340 of FIG. 3.

On the left of FIG. 3 the voltage regulator 300 comprises a resistive voltage divider 301. The resistive voltage divider 301 generates a reference voltage VREF which is a fraction of a supply voltage VDDR supplied as input voltage to the voltage regulator 300. As an example VREF could be 0.7×VDDR. The resistive voltage divider 301 is coupled to an error amplifier 310. The error amplifier 310 comprises a biasing unit 311, a differential amplifier unit 312, a gain boosting unit 313 and a differential to-single-ended converter unit 314.

The differential amplifier unit 312 establishes a first gain stage, the gain boosting unit 313 a second gain stage and the differential-to-single ended converter 314 a third gain stage.

The differential amplifier 312 of the second gain stage performs gain boosting via cross-coupled n-FETs connected in parallel to diode connected n-FETs.

The output of the error amplifier 310 is coupled to a buffer circuit 320. The buffer circuit 320 is implemented as source follower buffer with shunt feedback and compensation for load variations of the voltage regulator 300.

The biasing unit 311 provides bias voltages VB1 and VB2 for various components of the voltage regulator 300, e.g. for the differential amplifier 312, the converter 314 and the buffer circuit 320.

The reference voltage VREF is applied as input voltage VINN to an inverting (negative) input of the error amplifier 310.

The buffer circuit 320 comprises a source follower circuit 321 comprising a source follower transistor TS1 which is implemented as pFET. The source follower circuit 321 further comprises a shunt feedback loop comprising a shunt transistor TS2 as shunt feedback element. The shunt transistor TS2 is arranged in parallel to the source follower transistor TS1 and is implemented as nFET.

The source follower circuit 321 comprises furthermore a transistor TS3 which acts as current source for the source follower transistor TS1 and receives its bias voltage VB1 from the biasing circuit 311. The transistor TS3 is implemented as nFET. The source follower circuit 321 comprises furthermore a transistor TS4 which acts as current source for the shunt feedback transistor TS2 and also receives its bias voltage VB2 from the biasing circuit 311. The transistor TS4 is implemented as pFET.

The output signal VCTL of the error amplifier 310 is fed in parallel to the gate of the source follower transistor TS1 and the gate of a sense transistor TL1. The sense transistor TL1 is implemented as nFET. The source of the sense transistor TL1, the source of the transistor TS3 and the source of the shunt transistor TS2 are coupled to ground. The drain of the sense transistor TL1 is coupled to a current mirror 322. The current mirror 322 comprises a diode connected transistor TL2 and a transistor TL3. The transistors TL2 and TL3 are implemented as pFETs. The drains of the transistors TL2, TL3 and TS4 are coupled to the supply voltage VDDR (which corresponds to VIN in FIG. 1 and FIG. 2). The drain of the transistor TL2 of the current mirror 322 is coupled to the drain of the sense transistor TL1. The gates of the transistors TL2 and TL3 of the current mirror 322 are coupled to each other. The drain of the transistor TL3 is coupled to the source of the source follower transistor TS1 and the drain of the transistor TS4 is coupled to the drain of the shunt transistor TS2. The source of the source follower transistor TS1 and the drain of the shunt transistor TS2 are coupled to each other and are furthermore coupled to the gate of a pass transistor 350 for supplying a gate control signal VGB to the gate of the pass transistor 350. The source of the pass transistor 350 is coupled to VDDR and the drain of the pass transistor 350 is coupled to a load resistance $R_L$.

The output impedance of the source follower transistor TS1 is inverse proportional to its transconductance. It could be lowered via an increase of the W/L-ratio. However, increasing the W/L-ratio of the source follower transistor TS1 is according to embodiments not desired since the input capacitance of the source follower transistor TS1 is preferably kept small in order to move the pole given by the output impedance of the error amplifier 310 and the input capacitance of the buffer circuit 320 to higher frequencies. Rather according to preferred embodiments the output impedance of the source follower transistor TS1 is controlled by the bias current supplied to the source follower transistor TS1 via the current mirror 322.

A first RC network R1, C1 is provided between the gate as control terminal of the pass transistor 350 and the drain as output terminal of the pass transistor 350. The RC network R1, C1 serves as Miller compensation. An output terminal 323 of the error amplifier 310 and the drain as output terminal of the pass transistor 350 are coupled via a second RC-network R2, C2. A third RC network R3, C3 (which may also be denoted as another second RC network) is provided between the drain of the pass transistor 350 and an output of the gain boosting unit 313. This provides additional Miller compensation and inserts additional zeros in the transfer characteristic for frequency compensation.

Furthermore, the source of the pass transistor 350 is coupled to a non-inverting input of the error amplifier 310 to provide an error amplifier input signal VINP to the non-inverting input of the error amplifier 310.

In the following the function and operation of the voltage regulator 300 and its components is explained in more detail.

By a low output impedance of the buffer circuit 320 the pole given by the large gate capacitance of the pass transistor 350 can be moved to higher frequencies. The buffer circuit 320 splits the original pole $\omega_{p2}$, where no buffer exists between the error amplifier 310 and the pass transistor 350, into two higher frequency poles. This stabilizes the voltage regulator 300 if the zeros are located well below the closed-loop unity gain frequency. To introduce additional zeros the conventional Miller compensation via the first RC-network R1 and C1 is extended with the two additional feed-forward paths given by the second RC networks R2, C2 and R3, C3.

The shunt transistor TS2 is connected in parallel to the output of the source follower transistor TS1 and provides a negative feedback. This lowers the output impedance of the source follower transistor TS1. For an increasing output signal VCTL of the error amplifier 310 the current flow through the source follower transistor TS1 reduces, but the one through the shunt transistor TS2 increases and vice versa.

According to the above equation for $\omega_{p2}$, the pole $p_2$ can be kept at approximately the same location by decreasing $R_{par}$ if $R_L$ increases and vice versa. This is achieved according to embodiments of the present disclosure by the buffer circuit 320.

More particularly, the sense transistor TL1 acts as load detector that detects the load current IL by monitoring the output voltage VCTL of the error amplifier 310. As the source follower transistor TS1 acts as source follower, the gain is essentially "1". This means that VCTL and the gate control voltage VGB behave in the same manner. In other words, VCTL and VGB decrease simultaneously or increase simultaneously. Hence if VCTL is small, the gate control voltage VGB at the gate of the pass transistor 350 is small as well. As the pass transistor 350 is a PFET, the pass transistor 350 is turned on strongly and sources a lot of current. The higher VCTL becomes, the more the pass transistor 350 turns off and the smaller is the load current IL. Accordingly the output voltage VCTL of the error amplifier 310 is an indirect measure of the load current IL of the voltage regulator 300.

The sense transistor TL1 forwards/conveys the information of the detected load current IL to the current mirror 322 comprising the pFETs TL2 and TL3. As the sense transistor TL1 is implemented as nFET and the current mirror 322 is implemented by the two pFETs TL2 and TL3, the current mirror 322 behaves in an opposite manner to the operation of the pFET pass transistor 350. In other words, the sense transistor TL1 controls the current that is fed to the transistor TL2 in such a way that if VCTL decreases (because IL increases), the current sourced by the current mirror 322 to the source follower transistor TS1 decreases and vice versa. Accordingly, the current that the current mirror 322 provides to the source follower transistor TS1 is inverse proportional to the load current IL of the voltage regulator 300.

Now if the pass transistor 350 throttles the load current IL, VCTL increases, the gate voltage of the source follower transistor TS1 decreases (as TS1 is a pFET) and correspondingly the output impedance of the source follower transistor TS1 increases. This would move $\omega_{p2}$ to lower frequencies and would reduce the bandwidth and negatively impact the stability. To avoid this, the current mirror 322 counteracts by sourcing more current to the source follower transistor TS1. This reduces the output impedance of the source follower transistor TS1 so that the increased output impedance due to the increased gate voltage of the source follower transistor TS1 gets compensated by the lower output impedance due to the higher bias current sourced by the current mirror 322 into the source follower transistor TS1. In other words, if the output impedance of the source follower transistor TS1 increases due to an increase of VCTL, this gets immediately compensated by the biasing current supplied to TS1 via the current mirror 322. This elegant, efficient and simple compensation scheme is based on the fact that the source follower transistor TS1 is embodied as pFET, while the sense transistor TL1 is embodied as nFET and as both are supplied with the same gate control voltage, namely VCTL. Hence if VCTL increases, the current through the sense transistor TL1 increases while the "inherent" current of the source follower transistor TS1 decreases. The increased current of TL1 is fed via the current mirror TL2 and TL3 into the source follower transistor TS1 and compensates the decreased "inherent" current of TS1.

Hence by regulating the output impedance of the buffer circuit 320, pole displacements and a degradation of the phase stability due to load variations at the output of the voltage regulator 300 can be avoided.

The sense transistor TL1 serves as load detector that senses the load of the voltage regulator 300 via the output voltage VCTL of the error amplifier 310 and provides as load signal SL a current to the current mirror 322. The current mirror 322 and the source follower transistor TS1 serve as load compensator. The current mirror 322 receives the load signal SL (see FIG. 4) from the sense transistor TL1. The source follower transistor TS1 changes its output impedance based on the load signal SL such that variations of the load of the voltage regulator 300 are compensated. More particularly, the bias current applied by the current mirror 322 to the source follower transistor TS1 compensates for the output impedance changes that the output signal VCTL of the error amplifier applied to the gate of the source follower transistor TS1 causes.

This compensation scheme according to embodiments of the present disclosure is in particular useful for DDR memory links which are operated in burst mode and hence face large load changes.

Figure 5:
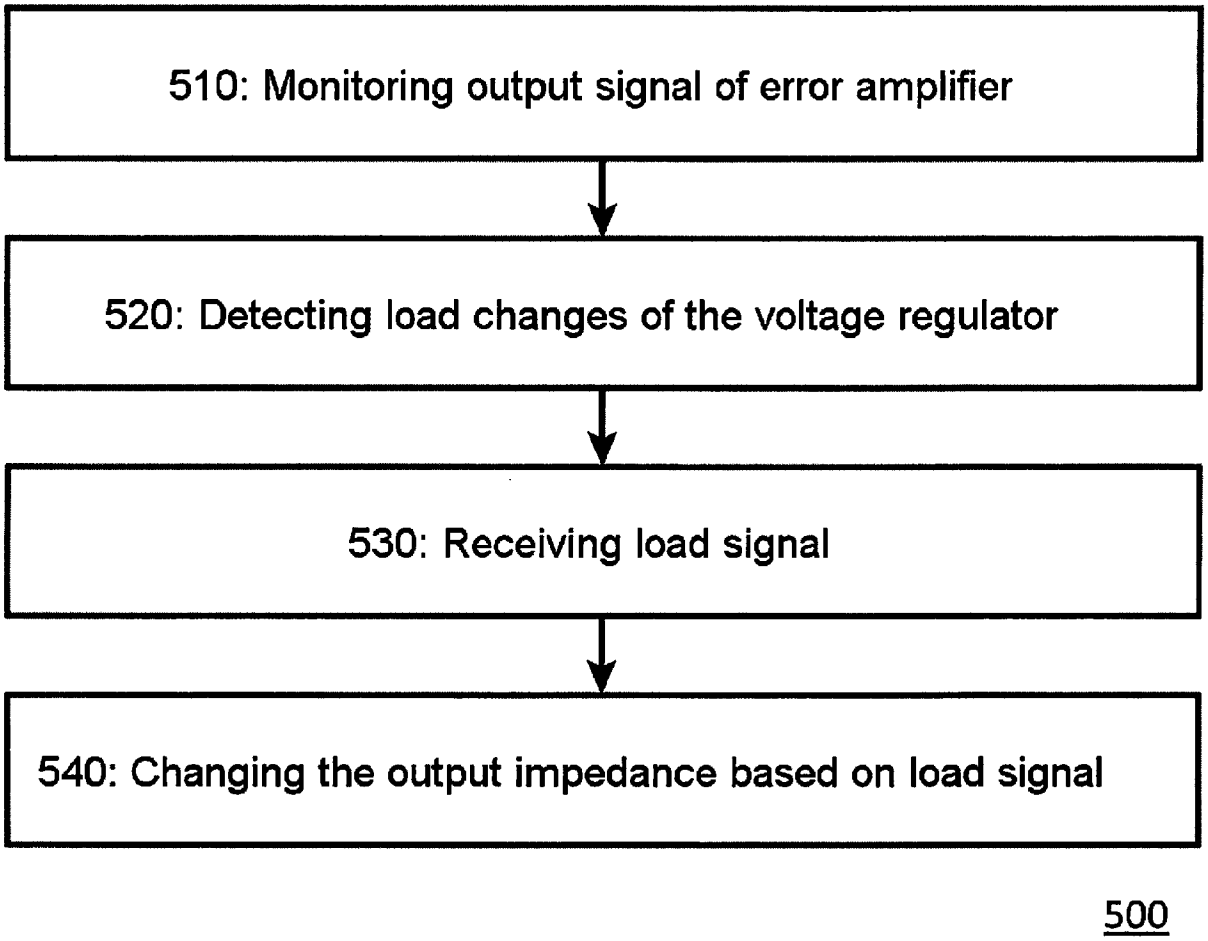
FIG. 5 shows a flow chart of a method for operating a voltage regulator according to an embodiment of the present disclosure.

FIG. 5 shows a flowchart 500 of method steps of a method for handling load changes of a low dropout voltage regulator, e.g. of the voltage regulators 100, 200 or 300 as described with reference to FIGS. 1, 2 3 and 4.

At a step 510, the load detector monitors an output signal of the error amplifier.

At a step 520, the load detector detects a load change of the load of the regulator.

At a step 530, the load compensator receives a load signal from the load detector which indicates the load of the regulator.

At a step 540, the load compensator changes its output impedance based on the received load signal. Thereby it compensates possible pole/zero shifts in the transfer characteristic due load variations at the voltage regulator output.

Figure 6:
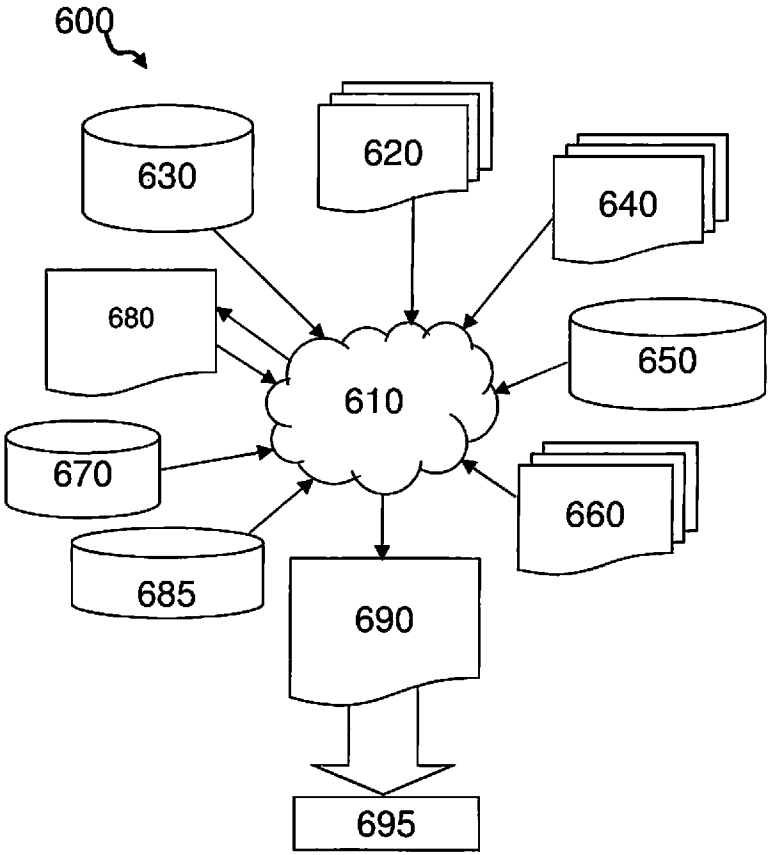
FIG. 6 shows a block diagram of an exemplary design flow used for example, in semiconductor IC logic design, simulation, test, layout, and manufacture.

FIG. 6 shows a block diagram of an exemplary design flow 600 used for example, in semiconductor IC logic design, simulation, test, layout, and manufacture. Design flow 600 includes processes, machines and/or mechanisms for processing design structures or devices to generate logically or otherwise functionally equivalent representations of the design structures and/or devices described above and shown e.g. in FIGS. 1, 2, 3 and 4. The design structures processed and/or generated by design flow 600 may be encoded on machine-readable transmission or storage media to include data and/or instructions that when executed or otherwise processed on a data processing system generate a logically, structurally, mechanically, or otherwise functionally equivalent representation of hardware components, circuits, devices, or systems. Machines include, but are not limited to, any machine used in an IC design process, such as designing, manufacturing, or simulating a circuit, component, device, or system. For example, machines may include: lithography machines, machines and/or equipment for generating masks (e.g. e-beam writers), computers or equipment for simulating design structures, any apparatus used in the manufacturing or test process, or any machines for programming functionally equivalent representations of the design structures into any medium (e.g. a machine for programming a programmable gate array).

Design flow 600 may vary depending on the type of representation being designed. For example, a design flow 600 for building an application specific IC (ASIC) may differ from a design flow 600 for designing a standard component or from a design flow 600 for instantiating the design into a programmable array, for example a programmable gate array (PGA) or a field programmable gate array (FPGA) offered by Altera® Inc. or Xilinx® Inc.

FIG. 6 illustrates multiple such design structures including an input design structure 620 that is preferably processed by a design process 610. Design structure 620 may be a logical simulation design structure generated and processed by design process 610 to produce a logically equivalent functional representation of a hardware device. Design structure 620 may also or alternatively comprise data and/or program instructions that when processed by design process 610, generate a functional representation of the physical structure of a hardware device. Whether representing functional and/or structural design features, design structure 620 may be generated using electronic computer-aided design (ECAD) such as implemented by a core developer/designer. When encoded on a machine-readable data transmission, gate array, or storage medium, design structure 620 may be accessed and processed by one or more hardware and/or software modules within design process 610 to simulate or otherwise functionally represent an electronic component, circuit, electronic or logic module, apparatus, device, or system such as those shown in FIGS. 1, 2 and 5. As such, design structure 620 may comprise files or other data structures including human and/or machine-readable source code, compiled structures, and computer-executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 610 preferably employs and incorporates hardware and/or software modules for synthesizing, translating, or otherwise processing a design/simulation functional equivalent of the components, circuits, devices, or logic structures shown in FIGS. 1, 2, 3 and 4 to generate a Netlist 680 which may contain design structures such as design structure 620. Netlist 680 may comprise, for example, compiled or otherwise processed data structures representing a list of wires, discrete components, logic gates, control circuits, I/O devices, models, etc. that describes the connections to other elements and circuits in an integrated circuit design. Netlist 680 may be synthesized using an iterative process in which netlist 680 is resynthesized one or more times depending on design specifications and parameters for the device. As with other design structure types described herein, netlist 680 may be recorded on a machine-readable data storage medium or programmed into a programmable gate array. The medium may be a non-volatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 610 may include hardware and software modules for processing a variety of input data structure types including Netlist 680. Such data structure types may reside, for example, within library elements 630 and include a set of commonly used elements, circuits, and devices, including models, layouts, and symbolic representations, for a given manufacturing technology (e.g., different technology nodes, 32 nm, 45 nm, 90 nm, etc.). The data structure types may further include design specifications 640, characterization data 650, verification data 660, design rules 670, and test data files 685 which may include input test patterns, output test results, and other testing information. Design process 610 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 610 without deviating from the scope and spirit of the invention. Design process 610 may also include modules for performing standard circuit design processes such as timing analysis, verification, design rule checking, place and route operations, etc.

Design process 610 employs and incorporates logic and physical design tools such as HDL compilers and simulation model build tools to process design structure 620 together with some or all of the depicted supporting data structures along with any additional mechanical design or data (if applicable), to generate a second design structure 690. Design structure 690 resides on a storage medium or programmable gate array in a data format used for the exchange of data of mechanical devices and structures (e.g. information stored in a IGES, DXF, Parasolid XT, JT, DRG, or any other suitable format for storing or rendering such mechanical design structures). Similar to design structure 620, design structure 690 preferably comprises one or more files, data structures, or other computer-encoded data or instructions that reside on transmission or data storage media and that when processed by an ECAD system generate a logically or otherwise functionally equivalent form of one or more of the embodiments of the invention shown in FIGS. 1, 2, 3 and 4. In one embodiment, design structure 690 may comprise a compiled, executable HDL simulation model that functionally simulates the devices shown in FIGS. 1, 2, 3 and 4.

Design structure 690 may also employ a data format used for the exchange of layout data of integrated circuits and/or symbolic data format (e.g. information stored in a GDSII (GDS2), GL1, OASIS, map files, or any other suitable format for storing such design data structures). Design structure 690 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 1, 2, 3 and 4. Design structure 690 may then proceed to a stage 695 where, for example, design structure 690: proceeds to tape-out, is released to manufacturing, is released to a mask house, is sent to another design house, is sent back to the customer, etc.

While the present invention has been described with reference to a limited number of embodiments, variants and the accompanying drawings, it will be understood by those skilled in the art that various changes may be made and equivalents may be substituted without departing from the scope of the present invention. In particular, a feature (device-like or method-like) recited in a given embodiment, variant or shown in a drawing may be combined with or replace another feature in another embodiment, variant or drawing, without departing from the scope of the present invention. Various combinations of the features described in respect of any of the above embodiments or variants may accordingly be contemplated, that remain within the scope of the appended claims. In addition, many minor modifications may be made to adapt a particular situation or material to the teachings of the present invention without departing from its scope.

Therefore, it is intended that the present invention not be limited to the particular embodiments disclosed, but that the present invention will include all embodiments falling within the scope of the appended claims. In addition, many other variants than explicitly touched above can be contemplated.

What is claimed is:

1. A voltage regulator comprising an error amplifier providing an output signal that is a direct measure of the regulator load;

a pass transistor; and a buffer circuit arranged between the error amplifier and the pass transistor;

wherein the buffer circuit comprises a load detector configured to detect a load current of the regulator by directly sensing the output signal of the error amplifier; and a load compensator comprising:

a source follower circuit having a source follower transistor;

a shunt feedback transistor connected at a source terminal of said source follower transistor in parallel to the source follower transistor and providing a negative shunt feedback signal configured to change a source follower transistor output impedance;

a current mirror configured to provide in dependence on the load of the regulator a first bias current to the source follower transistor, thereby changing the output impedance of the source follower transistor to compensate for variations of the load of the regulator, and a further transistor connected in parallel to said current mirror to provide a second bias current for the shunt feedback transistor, thereby providing a fixed output impedance of the source follower transistor; and said source follower circuit configured to receive a load signal from the load detector, the load signal indicating the load of the regulator;

to change its output impedance based on the load signal such that variations of the load of the voltage regulator are compensated.

2. The voltage regulator according to claim 1, wherein the current mirror is configured such that the current it sources to the source follower transistor is inverse proportional to the load current of the regulator.

3. The voltage regulator according to claim 1, wherein the load detector is configured to directly sense the output voltage of the error amplifier.

4. The voltage regulator according to claim 3, wherein the load detector comprises a sense transistor configured to directly sense the output voltage of the error amplifier.

5. The voltage regulator according to claim 4, wherein the sense transistor is configured to provide the load signal as an input current to the current mirror of the load compensator.

6. The voltage regulator according to claim 1, wherein the buffer circuit comprises a first RC-network as Miller compensation between a control terminal of the pass transistor and an output terminal of the pass transistor.

7. The voltage regulator according to claim 1, wherein the buffer circuit comprises one or more second RC-networks as miller compensation between an output terminal of the pass transistor and an output terminal of the error amplifier.

8. The voltage regulator according to claim 1, wherein the pass transistor is implemented as p-FET;

the sense transistor is implemented as n-FET; and the current mirror is implemented by two or more p-FETs.

9. The voltage regulator according to claim 1, wherein the pass transistor is implemented as n-FET;

the sense transistor is implemented as p-FET; and the current mirror is implemented by two or more n-FETs.

10. The system comprising a voltage regulator according to claim 1 and a computerized device, the voltage regulator being configured to provide an output voltage to the computerized device.

11. The system as claimed in claim 10, wherein the computerized device is a double data rate (DDR) memory module.

12. A method for handling load changes of a voltage regulator, the voltage regulator being configured to convert an input voltage into an output voltage, the voltage regulator comprising:

an error detector amplifier providing an output signal that is a direct measure of the regulator load;

a pass transistor; and a buffer circuit arranged between the error detector and the pass transistor, the buffer circuit comprising a load detector and a load compensator;

the method comprising directly sensing, by the load detector, an output signal of the error amplifier;

detecting, by the load detector, load changes of a load of the voltage regulator;

receiving, by the load compensator, a load signal from the load detector, the load signal indicating the load of the voltage regulator;

said load compensator comprising:

a source follower buffer having a source follower transistor, a shunt feedback transistor connected at a source terminal of said source follower transistor in parallel to the source follower transistor, and a current mirror configured to provide in dependence on the load of the regulator a first bias current to the source follower transistor, and a further transistor connected in parallel to said current mirror to provide a second bias current for the shunt feedback transistor;

said method further comprising:

providing, by said current mirror, a first bias current to the source follower transistor in dependence on the load of the regulator to thereby change the output impedance of the source follower transistor to compensate for variations of the load of the regulator;

providing a second bias current to said further transistor to provide a fixed output impedance of the source follower transistor, and providing, by the shunt feedback transistor, a negative shunt feedback signal for changing the output impedance of the source follower buffer of the load compensator based on the load signal, thereby compensating variations of the load of the voltage regulator.

13. The method according to claim 12, further comprising:

sourcing, by the current mirror, current to the source follower transistor that is inverse proportional to the load current of the regulator.

14. A design structure tangibly embodied in a machine readable medium for designing, manufacturing, or testing an integrated circuit, the design structure comprising:

a voltage regulator comprising an error amplifier;

a pass transistor; and a buffer circuit arranged between the error amplifier and the pass transistor;

wherein the buffer circuit comprises a load detector configured to detect a load current of the regulator by monitoring an output signal of the error amplifier; and a load compensator comprising:

a source follower circuit having a source follower transistor; and a shunt feedback transistor connected at a source terminal of said source follower transistor in parallel to the source follower transistor and providing a negative shunt feedback signal configured to change a source follower transistor output impedance;

a current mirror configured to provide in dependence on the load of the regulator a first bias current to the source follower transistor, thereby changing the output impedance of the source follower transistor to compensate for variations of the load of the regulator, and a further transistor connected in parallel to said current mirror to provide a second bias current for the shunt feedback transistor, thereby providing a fixed output impedance of the source follower transistor; and said source follower circuit configured to receive a load signal from the load detector, the load signal indicating the load of the regulator; and to change its output impedance based on the load signal such that variations of the load of the voltage regulator are compensated.

* * * * *